United States Patent [19]

Hampton

[11] Patent Number: 4,723,531

[45] Date of Patent: Feb. 9, 1988

[54] B-B LOADING DEVICE

[76] Inventor: Harvie G. Hampton, 1863 S. Brookwood, Shreveport, La. 71118

[21] Appl. No.: 887,892

[22] Filed: Jul. 21, 1986

[51] Int. Cl.[4] ..... F41C 25/00; A47F 1/00

[52] U.S. Cl. ..... 124/45; 221/288; 222/456

[58] Field of Search ..... 124/45, 49, 50; 141/300, 319, 331, 334, 310, 337, 367; 222/456, 363, 462; 221/288, 306, 263

[56] References Cited

U.S. PATENT DOCUMENTS

| | | | |
|---|---|---|---|
| 906,420 | 12/1908 | Heilprin | 141/334 |
| 952,313 | 3/1910 | Droz | 141/334 |
| 1,166,776 | 1/1916 | Moore | 141/331 |
| 1,295,508 | 2/1919 | Hughes | 222/358 |
| 1,955,559 | 4/1934 | Narrow | 124/45 |
| 2,529,004 | 11/1950 | Eley | 141/319 |
| 2,623,523 | 12/1952 | Benson | 222/461 |
| 2,676,370 | 4/1954 | Doehler et al. | 222/356 |
| 3,263,664 | 8/1966 | Bauer et al. | 124/49 |
| 4,347,878 | 9/1982 | Schofield | 141/300 |
| 4,564,125 | 1/1986 | Esslinger | 124/45 |

FOREIGN PATENT DOCUMENTS

| | | | |
|---|---|---|---|
| 387821 | 2/1933 | United Kingdom | 227/462 |

*Primary Examiner*—Richard C. Pinkham
*Assistant Examiner*—Gary Jackson
*Attorney, Agent, or Firm*—John M. Harrison

[57] ABSTRACT

A b-b loading device which in a first preferred embodiment is characterized by a tubular-shaped loader having an internal cavity, a loading slot located near one end of the loader and a loading head characterized by a nozzle and nozzle bore at the opposite end, with a pair of flexible loading guides disposed adjacent to and spanning the nozzle and nozzle bore in the loading head for loading b-b's from the loader into a b-b gun. The b-b's are dispensed through the nozzle bore from the housing cavity and are guided into an opening in the gun barrel by means of the loading guides. In a second preferred embodiment the b-b loading device is characterized by a detachable loading head which is threaded to a bottle for coating the b-b's and in a third embodiment, the b-b loading device includes a loading head which is removably attached to a hollow, b-b-containing cylinder fitted with a pocket clip.

15 Claims, 8 Drawing Figures

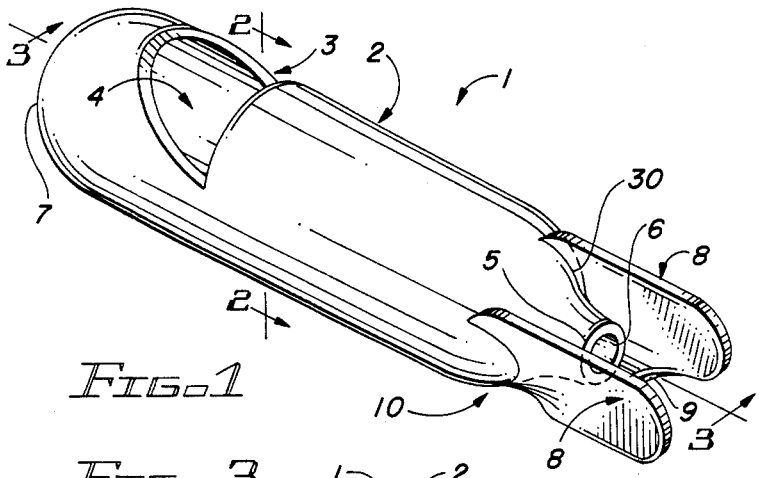
FIG. 1
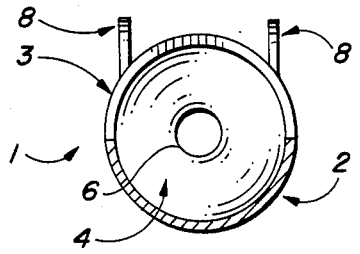
FIG. 2
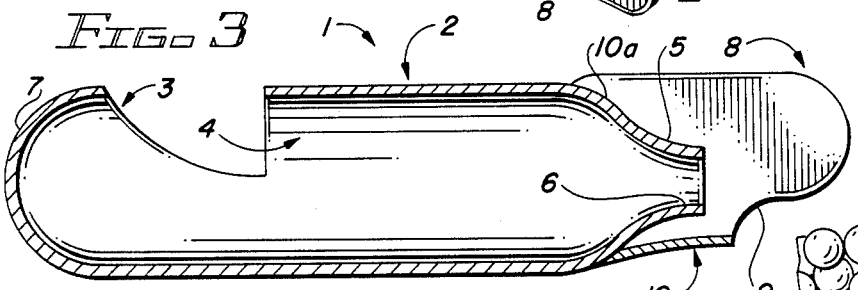
FIG. 3
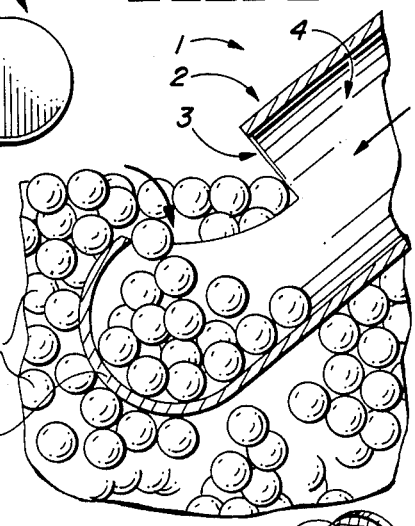
FIG. 4
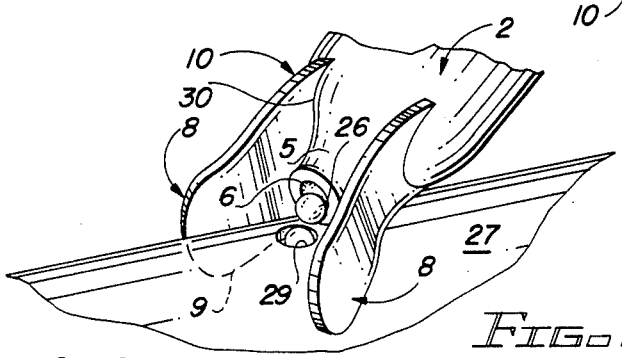
FIG. 5
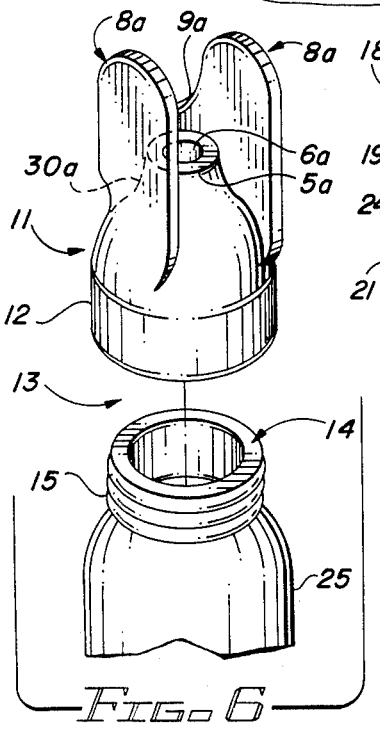
FIG. 6
FIG. 8
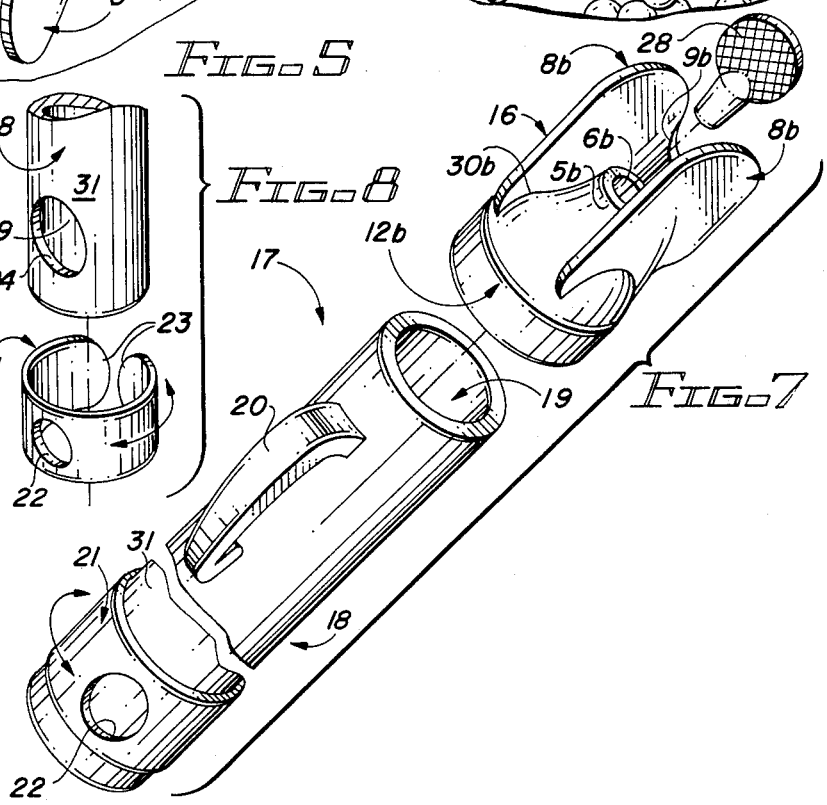
FIG. 7

B-B LOADING DEVICE

BACKGROUND OF THE INVENTION

1. Field of the Invention

This invention relates to air rifles or b-b guns and more particularly, to a b-b loading device for quickly and efficiently loading a b-b gun. In a first preferred embodiment the b-b loading device of this invention is characterized by a hollow tubular-shaped container or loader having a loading slot provided in one end for receiving and storing b-b's in the container cavity and an integral loading head having a nozzle and nozzle bore located at the opposite end of the loader for loading b-b's into an opening provided in the b-b gun barrel. A pair of spaced, flexible loading guides extend from both sides of the nozzle area of the loading head and are connected along a bottom edge or margin to help guide the b-b's from the nozzle bore into the loading aperture or opening in the b-b gun. In another preferred embodiment, the nozzle, nozzle bore and loading guides are characterized by a loading head threaded on the neck of a bottle containing the b-b's, to define a second b-b loading device. In a third embodiment of the invention the nozzle, nozzle bore and loading guide combination, or loading head, is removably attached to a cylindrically-shaped b-b receptacle having a pocket clip thereon to define a third b-b loading device.

A problem which has long been recognized in loading air rifles and b-b guns is the problem of efficiently loading b-b's in the gun barrel without spilling the b-b's. A conventional means for loading the barrel of a b-b gun is to cup the barrel between the thumb and index finger of one hand and pour the b-b's from a receptacle into the loading port or opening, with the thumb and index finger held in close proximity to the opening, in order to guide the b-b's into the opening. Other techniques include loading the b-b's one-by-one into the barrel opening and placing the barrel on a flat surface and rolling the b-b's into the barrel opening from the container. Each of these techniques is time-consuming and tiresome and also results in spilling of the b-b's, with significant loss of b-b's sometimes occurring when the loading operation is undertaken outdoors. Even if the loading is done indoors, the spilled b-b's must be picked up, a procedure which is also time consuming and sometimes laborious, since the b-b's can roll under furniture and into relatively inaccessible areas.

2. Description of the Prior Art

Various types of devices are known in the art for funneling particulate material and small objects into a specific location for loading purposes. Typical of these patents is U.S. Pat. No. 952,313, dated Mar. 15, 1910, to E. J. Droz. The Droz "Scoop" includes a folded paper or cardboard member which is shaped to define a scoop having a broad receiving end and a narrow dispensing aperture, which scoop is designed to accumulate and dispense various types of particulate material. U.S. Pat. No. 1,166,776, dated Jan. 4, 1916, to G. G. Moore, discloses a "Funnel" having a lower stem adapted to fit in a receptacle or bottle to be filled and an enlarged, cylindrically-shaped upper portion for introducing material into the funnel. In one embodiment the funnel is equipped with multiple receiving bowls which may be detached from the cylindrical body. A "Powder Applicator Having A Powder-Receiving Spout And A Recessed Outlet Accomodating A Toothbrush" is disclosed in U.S. Pat. No. 2,529,004, dated Nov. 7, 1950, to V. D. Eley. The container of this invention is provided with a filling spout which may be inserted in the discharge opening of a toothpowder receptacle such that the powder can be poured through the spout into the receptacle. The container is also provided with a toothbrush opening and an internal cylinder having an opening adapted to register with a spout for filling, at which time the toothbrush opening is closed. An internal cylinder is adapted to turn and close the spout in order to register with the toothbrush opening when it is desired to insert a toothbrush. The internal cylinder is also adapted to be manipulated for closing both openings when the device is not in use. U.S. Pat. No. 2,623,523, dated Dec. 30, 1952, to E. R. Benson, discloses an "Antiinfection Spreading Shield". The shield includes a funnel-shaped device having a handle, the narrow end of which funnel is designed to fit into a nostril and the flared open end adapted to receive the end of a medicine dropper or other medicine dispensing member. U.S. Pat. No. 4,347,878, dated Sept. 7, 1982, to Miles E. Schofield, discloses a "Funnel" which is equipped with a relatively wide mouth bowl for receiving a liquid such as gasoline or the like. The bowl allows a liquid to flow by gravity downwardly through an angularly disposed central section and further through a relatively small mouth spout for reception into a suitable receptacle such as the filler pipe of a vehicle fuel tank. The central section of the funnel is shaped to define a wedge for binding reception partially into the vehicle and further to define a flow path for venting air from the receptacle while the receptacle is being filled with a liquid. U.S. Pat. No. 2,820,392, dated Jan. 21, 1958, to M. M. Schmidt, discloses "Powder Measures" whicn include a body having an elongated cylindrical chamber, one end of which chamber is closed, with a movable plug having a concave end located in the chamber. Means are provided to hold the plug in predetermined positions in order to change the chamber capacity. The opposite end of the chamber is provided with an inwardly directed feed cone dimensioned to receive both the opening of a powder can and the open end of cartridge cases of various sizes to be loaded. A cut-off is positioned immediately below the feed cone and the device is constructed to be filled with powder from a container and to fill a cartridge case while held in the hands.

It is an object of this invention to provide a new and improved loading device for loading b-b's into an air rifle or b-b gun, wnich loading device is characterized by a nozzle provided with a nozzle bore and a pair of flexible loading guides disposed adjacent to and spanning the nozzle for guiding the b-b's from the nozzle bore into the loading aperture or opening of the gun barrel.

Another object of this invention is to provide a tubular loader for loading b-b's into the loading aperture or opening in a b-b gun or air rifle, which tubular loader is characterized by a tubular-shaped b-b container having a cavity therein, a loading slot communicating with the cavity at one end of the loader and a nozzle and nozzle bore communicating with the cavity at the opposite end thereof. The container is further provided with loading guides located adjacent to and spanning the nozzle for guiding the b-b's dispensed from the nozzle bore into the loading aperture or opening of the gun barrel.

Yet another object of this invention is to provide a b-b loading head for fitting to a container and loading b-b's from the container into an air rifle or b-b gun, which loading head is characterized by a dispensing nozzle, a nozzle bore provided in the dispensing nozzle for dispensing b-b's from the container and the loading head into a loading opening or aperture in the barrel of the gun and a pair of flexible loading guides provided in close proximity to the nozzle, whereby the loading guides serve to guide the b-b's from the nozzle bore into the loading opening.

A still further object of the invention is to provide a b-b loading device which is characterized by a loading head having a nozzle. a nozzle bore for dispensing b-b's into the loading opening of a b-b gun and a pair of loading guides provided adjacent the nozzle for guiding the b-b's into the loading aperture, which loading head is adapted in one embodiment for threadible attachment to a bottle containing b-b's or in another empodiment, for attachment to a cylindrical b-b container having a clip thereon for locating the loading device in the pocket of a shirt.

SUMMARY OF THE INVENTION

These and other objects of the invention are provided in a b-b loading device which is characterized in a first preferred embodiment by a tubular loader provided with an integral loading head shaped to define a nozzle and a nozzle bore for dispensing b-b's from an interior cavity in the tubular loader, with a pair of spaced-apart, flexible loading guides extending from the loading head on either side of the nozzle for guiding b-b's dispensed from the nozzle into the loading opening of a b-b gun barrel. In a preferred embodiment of the invention the tubular loader further includes a loading slot for loading b-b's into the interior cavity. In another preferred embodiment, the loading head is characterized by a threaded portion for threading on the neck of a bottle containing a supply of the b-b's to define a bottle load1ng device. In a third preferred embodiment of the invention a clip loading device is provided, with a loading head having a friction neck which is adapted to slidably and removably attach to a cylindrically-shaped barrel provided with a clip and adapted to contain a quantity of b-b's, in order to removably attach the clip loader in the pocket of a shirt.

BRIEF DESCRIPTION OF THE DRAWING

The invention will be better understood by reference to the accompanying drawing, wherein:

FIG. 1 is a perspective view of a preferred tubular loader b-b loading device of this invention;

FIG. 2 is a transverse sectional view taken along line 2—2 of the tubular loader illustrated in FIG. 1;

FIG. 3 is a longitudinal sectional view taken along line 3—3 of the tubular loader illustrated in FIG. 1;

FIG. 4 is a sectional view of the loading slot and rear area of the tubular loader housing, more particularly illustrating a preferred method of loading b-b's into the housing;

FIG. 5 is a perspective view, partially in section, of the loading head of the tubular loader illustrated in FIG. 1, with the loading head oriented in loading position with respect to the barrel and loading opening of a b-b gun;

FIG. 6 is a perspective view, partially in section, of a threaded loading head and bottle in a bottle loader version of the b-b loading device of this invention;

FIG. 7 is a perspective view of a friction loading head and clip barrel in a clip loader version of the b-b loading device of this invention; and FIG. 8 is a perspective view, partially in section, of a preferred means for receiving b-b's into the clip barrel of the clip loader and maintaining the b-b's in the clip barrel.

DESCRIPTION OF THE PREFERRED EMBODIMENTS

Referring initially to FIGS. 1–4 of the drawing in a preferred embodiment the b-b loading device of this invention is generally illustrated by a tubular loader generally designated by reference numeral 1. The tubular loader 1 is characterized by a hollow tube housing 2, provided with a loading slot 3 at one end, which loading slot 3 communicates with the housing cavity 4. A loading head is generally illustrated by reference numeral 10 and is defined by the opposite end of the tube housing 2. A nozzle 5 is provided in the loading head 10 of the tube housing 2 and is further characterized by a nozzle bore 6 of sufficient size to allow the b-b's 26 to individually pass from the housing cavity 4 through the nozzle bore 6. A pair of flexible loading guides 8 extend from the shoulder 30 of the loading head 10 on each side of the nozzle 5 and are joined along a guide margin 9 at the bottom thereof, in order to define a guide for accurately dispensing a quantity of b-b's 26 through the nozzle bore 6, as hereinafter described. It is understood that the entire forward segment of the tubular loader 1 is designated as the loading head 10, which loading head 10 includes the forward portion of the tube housing 2, the nozzle 5, nozzle bore 6 and the loading guides 8. In the FIGS. 1–4 embodiment of the invention the loading head 10 is formed integrally with the tube housing 2 to define the dispensing end of the tubular loader 1. As illustrated in FIG. 4 of the drawing when it is desired to load the tubular loader 1 with the b-b's 26, the slot end 7 of the tube housing 2 is inserted in a quantity of the b-b's 26 and the b-b's 26 are caused to enter the housing cavity 4 through the loading slot 3, as illustrated.

Referring now to FIG. 5 of the drawings, when it is desired to transfer the b-b's loaded in the housing cavity 4 of the tube housing 2 to a b-b gun through the loading head 10, the nozzle 5 is initially placed adjacent the loading opening 29 of the gun barrel 27, as illustrated. When the nozzle bore 6 is located immediately adjacent the loading opening 29 in the gun barrel 27, the flexible loading guides 8 are flared slightly outwardly by pressure applied to the tube housing 2. The loading guides 8 then lie adjacent the gun barrel 27 along the curved guide margin 9 as illustrated, in order to funnel and guide the b-b's 26 which are dispensed from the nozzle bore 6 into the loading opening 29. Accordingly, it will be appreciated by those skilled in the art that when the tubular loader 1 is positioned with respect to the gun barrel 27 as illustrated in FIG. 5, the b-b's 26 will readily flow in a steady stream one-by-one from the housing cavity 4 through the nozzle bore 6 and into the gun barrel 27 through the loading opening 29, without spilling.

Referring now to FIG. 6 of the drawing in another preferred embodiment of the invention a threaded loading head 11 is provided in association with a bottle 25 to define a bottle loader 13, which bottle 25 contains a quantity of the b-b's 26. It will be appreciated by those skilled in the art that the threaded detachable loading head 11 is identical in design to the loading head 10 illustrated in FIGS. 1–5, with the exception of the threaded collar 12, which is designed with internal threads (not illustrated) for threadably engaging the external neck threads 15 provided on the bottle neck 14 of the bottle 25. The threaded loading head 11 is characterized by the internally threaded collar 12, which tapers at the shoulder 30*a* to define a bottle nozzle 5*a*, provided with a bottle nozzle bore 6*a*. A pair of bottle loading guides 8*a*, connected by a bottle loading guide margin 9*a*, project from the threaded collar 12 on both sides of the bottle nozzle 5*a* in spaced relationship. The bottle loader 13 is designed to be used in the same manner as the tubular loader 1, with the threaded loading head 11 threadably tightened on the bottle neck 14 of the bottle 25 and positioned in association with the gun barrel 27 and the loading opening 29 in the same manner as the loading head 10 illustrated in FIG. 5. B-b's can then be rolled from the bottle 25 through the bottle nozzle bore 6*a* of the bottle nozzle 5*a*, using the bottle loading guides 8*a* to channel and guide the b-b's 26 into the loading opening 29.

Referring now to FIGS. 7 and 8 of the drawing in yet another preferred embodiment of the invention a clip loader 17 is illustrated, with a friction loading head 16 tightly fitted over the open end of a cylindrically-shaped clip barrel 18, provided with a barrel bore 19 and a clip 20, as illustrated. The friction loading head 16 is characterized by a round friction collar 12*b*, which tapers to define a shoulder 30*b* and a barrel nozzle 5*b*, provided with a barrel nozzle bore 6*b*. A pair of barrel loading guides 8*b* project from the shoulder 30*b* of the friction collar 12*b* on both sides of the barrel nozzle 5*b* and are connected by a barrel loading guide margin 9*b*. It is understood that the friction loading head 16 can also be permanently attached to or integrally formed with the clip barrel 18 in the same manner as the loading head 10 is integrally formed with the tube housing 2 in the tubular loader 1, illustrated in FIGS. 1–4. Under these circumstances, a barrel sleeve 21 is slidably positioned on the lower end 31 of the clip barrel 18 and is provided with a sleeve opening 22, which is centrally located between the facing sleeve ends 23. The sleeve opening 22 is designed to selectively register with a barrel opening 24 provided in the lower end 31 of the clip barrel 18, in order to provide a means for loading a quantity of the b-b's 26 into the clip barrel 18. Accordingly, it will be appreciated that when the friction collar 12*b* of the friction loading head 16 is either tightly fitted onto or permanently attached to the clip barrel 18, the b-b's 26 can be dispensed from the barrel nozzle bore 6*b* of the barrel nozzle 5*b* into the loading opening 29 of the gun barrel 27, when the barrel loading guides 8*b* are positioned adjacent the gun barrel 27 in the same manner as the loading guides 8 of the loading head 10, as illustrated in FIG. 5. In a still further preferred embodiment of the invention a plug 28 can be inserted in the nozzle bore 6, bottle nozzle bore 6*a* or the barrel nozzle bore 6*b*, in order to plug the nozzle 5, bottle nozzle 5*a* and barrel nozzle 5*b*, respectively, to prevent loss of the b-b's 26, as desired.

It will be appreciated by those skilled in the art that the tubular loader 1, bottle loader 13 and the clip loader 17 are only exemplary of the various types of b-b loading devices which can be used to insert b-b's in the loading opening 29 of a gun barrel 27. Accordingly, the loading head 10, threaded loading head 11 and the friction loading head 16 can be shaped in or inserted on various types of containers other than the illustrated tube housing 2, bottle 25 and clip barrel 18, respectively, in order to provide a source of b-b's for dispensing through the loading head 10, threaded loading head 11 and friction loading head 16, as desired. Furthermore, in a most preferred embodiment of the invention the loading guides 8, bottle loading guides 8*a* and barrel loading guides 8*b* are flexible and easily deformed in order to more easily press the loading guides 8, bottle loading guides 8*a* and barrel loading guides 8*b* and the respective guide margin 9, bottle loading guide margin 9*a* and barrel loading guide margin 9*b* against the gun barrel 27. Accordingly, the loading guides 8, bottle loading guides 8*a* and barrel loading guides 8*b* can be constructed of a deformable material such as plastic, in non-exclusive particular, according to the knowledge of those skilled in the art.

While the preferred embodiments of the invention have been described above, it will be recognized and understood that various modifications may be made and used therein and the appended claims are intended to cover all such modifications and combinations which may fall within the spirit and scope of the invention.

Having described my invention with the particularity set forth above, what is claimed is:

1. A b-b loading device for loading b-b's into the loading opening of a b-b gun, comprising a loading head characterized by a hollow, tubular base member having an open end, said tubular base member tapering at the opposite end to define a nozzle; a nozzle bore provided in said nozzle, said nozzle bore having a diameter which is larger than the diameter of the b-b's; and a pair of loading guides projecting from said opposite end of said tubular base member and spanning said nozzle in substantially parallel relationship, said loading guides connected by a curved guide margin, whereby the b-b's are loaded from said tubular base member through said nozzle bore the loading opening when said nozzle is positioned adjacent the loading opening and said loading guides are pressed against the barrel of the b-b gun along said curved guide margin.

2. The b-b loading device of claim 1 further comprising a tube housing integrally provided in said tubular base member and an opening provided in said tube housing for loading a supply of b-bs into said tube housing and said tubular base member.

3. The b-b loading device of claim 2 wherein said opening is shaped to define a slot.

4. The b-b loading device of claim 1 wherein said loading guides are flexible.

5. The b-b loading device of claim 4 further comprising a tube housing integrally formed in said tubular base member and an opening provided in said tubular base member and an opening provided in said tube housing for loading a supply of b-bs into said tube housing and said tubular base member.

6. The b-b loading device of claim 5 wherein said opening is shaped to define a slot.

7. The b-b loading device of claim 1 further comprising internal threads provided in said tubular base member and a container for carrying a supply of b-bs, a neck extending from said container and external threads provided on said neck for mating with said internal threads in said tubular base member and removably securing said loading head to said container.

8. The b-b loading device of claim 7 wherein said loading guides are connected by a curved guide margin for fitting said loading guides and said guide margin against the barrel of the b-b gun.

9. The b-b loading device of claim 8 wherein said loading guides are flexible.

10. The b-b loading device of claim 1 further comprising a generally cylindrically-shaped clip barrel having a hollow bore, said clip barrel being open at one end and closed at the opposite end and a clip provided on said clip barrel, said one end of said clip barrel adapted to receive said tubular base for dispensing b-bs stored in said clip barrel through said nozzle bore in said tubular base.

11. The b-b loading device of claim 10 further comprising a barrel opening provided in said clip barrel, a barrel sleeve slidably carried by said clip barrel and a sleeve opening provided in said barrel sleeve, whereby said barrel sleeve is slidably manipulated with respect to said clip barrel in a first configuration to align said sleeve opening with said barrel opening for loading b-bs into said clip barrel and said barrel sleeve is slidably manipulated in a second configuration to misalign said sleeve opening and said barrel opening to prevent b-bs from exiting said barrel opening.

12. The b-b loading device of claim 10 further comprising a barrel opening provided in said clip barrel, a barrel sleeve slidably carried by said clip barrel and a sleeve opening provided in said barrel sleeve, whereby said barrel sleeve is slidably manipulated with respect to said clip barrel in a first configuration to align siad sleeve opening with said barrel supply opening for loading b-bs into said clip barrel and said barrel sleeve is slidably manipulated in a second configuration to misalign said sleeve opening and said barrel supply opening to prevent b-bs from exiting said barrel supply opening.

13. The b-b loading device of claim 12 wherein said loading guides are flexible.

14. The b-b loading device of claim 13 wherein said loading guides are flat and substantially flexible.

15. A b-b loading device for loading b-b's into the loading opening in the barrel of a b-b gun, comprising a hollow, tubular-shaped member; a slot provided in said tubular-shaped member near one end of said tubular-shaped member for loading the b-b's into said tubular-shaped member; a loading head provided in the opposite end of said tubular-shaped member, said loading head characterized by a nozzle and nozzle bore provided in said nozzle, said nozzle bore having a diameter which is larger than the diameter of said b-b's; and a pair of loading guides projecting from said loading head and spanning said nozzle in spaced, generally parallel relationship, said loading guides connected by a curved guide margin, wherby said b-b's are loaded from said tubular-shaped member through said nozzle bore into the loading opening of the b-b gun when said nozzle is positioned adjacent the loading opening and said loading guides are pressed against the barrel of the b-b gun along said curved guide margin.

* * * * *